US008376164B2

(12) United States Patent
Perrin et al.

(10) Patent No.: US 8,376,164 B2
(45) Date of Patent: Feb. 19, 2013

(54) CAP WITHOUT ADDITIONAL SEAL

(75) Inventors: Gérard Perrin, Meyzieu (FR); Henri Pionchon, Lyons (FR)

(73) Assignee: Tetra Laval Holdings & Finance S.A., Pully (CH)

( * ) Notice: Subject to any disclaimer, the term of this patent is extended or adjusted under 35 U.S.C. 154(b) by 436 days.

(21) Appl. No.: 12/526,701

(22) PCT Filed: Feb. 13, 2008

(86) PCT No.: PCT/CA2008/000284

§ 371 (c)(1),
(2), (4) Date: Apr. 5, 2010

(87) PCT Pub. No.: WO2008/098362

PCT Pub. Date: Aug. 21, 2008

(65) Prior Publication Data

US 2010/0193464 A1 Aug. 5, 2010

(30) Foreign Application Priority Data

Feb. 13, 2007 (CA) ..... 2577886

(51) Int. Cl.
*B65D 53/00* (2006.01)

(52) U.S. Cl. .... 215/343; 215/341; 215/344; 215/DIG. 1

(58) Field of Classification Search ..... 206/219, 206/432, 497; 215/316, 253, 254, 256, 270–271, 215/329–331, 343; 220/86.1; 222/147
See application file for complete search history.

(56) References Cited

U.S. PATENT DOCUMENTS

| | | | | |
|---|---|---|---|---|
| 3,338,446 | A * | 8/1967 | Faulstich | 215/254 |
| 3,815,771 | A | 6/1974 | Marks | |
| 3,844,439 | A * | 10/1974 | Demers et al. | 215/344 |
| 3,944,104 | A * | 3/1976 | Watson et al. | 215/307 |

(Continued)

FOREIGN PATENT DOCUMENTS

| | | |
|---|---|---|
| CA | 1178927 | 12/1984 |
| CA | 1196606 | 11/1985 |

(Continued)

OTHER PUBLICATIONS

International Search Report for related International Application No. PCT/CA2008/000284; report dated Apr. 18, 2008.

*Primary Examiner* — Luan K Bui
*Assistant Examiner* — Brijesh Patel
(74) *Attorney, Agent, or Firm* — Finnegan, Henderson, Farabow, Garrett & Dunner, LLP

(57) ABSTRACT

There is described a cap without additional seal for closing an opening of a neck of a container. The cap comprises a closing disc; a peripheral skirt sized to fit around the neck, the peripheral skirt. The cap also comprises a first annular sealing lip projecting downwardly from under the closing disc, near the opening of the neck, the first annular sealing lip being folded against the neck and toward the opening of the neck when the cap is attached onto the neck, thereby allowing neutralization of any backwash effect when the container is moved. The cap also comprise a second annular sealing lip external to the first annular sealing lip and positioned so as to be also folded against the neck, in a direction opposite to that of the first annular sealing lip when the cap is attached onto the neck.

16 Claims, 4 Drawing Sheets

U.S. PATENT DOCUMENTS

| | | | | | |
|---|---|---|---|---|---|
| 4,089,463 | A | | 5/1978 | Babiol | |
| 4,162,736 | A | * | 7/1979 | Faulstich | 215/256 |
| 4,276,989 | A | | 7/1981 | Hicks | |
| 4,398,645 | A | | 8/1983 | Toeppen | |
| 4,461,392 | A | * | 7/1984 | Conti | 215/270 |
| 4,911,316 | A | * | 3/1990 | Tackles | 215/256 |
| 5,909,827 | A | * | 6/1999 | Bietzer et al. | 222/83.5 |
| 7,575,121 | B2 | * | 8/2009 | Ooka et al. | 215/344 |
| 2004/0129667 | A1 | * | 7/2004 | Nusbaum et al. | 215/250 |
| 2009/0223922 | A1 | * | 9/2009 | King | 215/330 |

FOREIGN PATENT DOCUMENTS

| | | |
|---|---|---|
| CA | 2057907 | 11/1990 |

* cited by examiner

CAP WITHOUT ADDITIONAL SEAL

TECHNICAL FIELD

The present invention relates to a cap without an additional seal, for use in closing and sealing a discharge opening at a container's neck, such as that of a liquid container.

BACKGROUND

A "cap without additional seal" is intended to refer to a cap with no attached seal, which permits a tight closure of the opening of a neck of a container storing a liquid for example, without the need for a seal such as a foam disk placed under the cap's closure disc, or an injected or moulded strip acting as an O-ring seal. To receive this type of seal, prior art caps are typically provided with a groove disposed under the closing disc for insertion of the seal therein. The pressure exerted by the tension ring or the anchoring system during manufacturing of the cap compresses the seal against the upper surface of the neck of the container to provide the desired tightness.

As mentioned above, the present invention relates to a cap which ensures excellent tightness without having such an attached seal.

Prior art caps without additional seal do already exist. By way of non-limitative examples, one may refer to the following United States patents: U.S. Pat. No. 3,325,033 (WEATON) in 1967; U.S. Pat. No. 3,815,771 (MARKS) in 1974; U.S. Pat. No. 4,106,653 (MARTINELLI) in 1978; U.S. Pat. No. 4,416,383 (FRAHM et al.) in 1983; U.S. Pat. No. 4,560,077 (DUTT) in 1985; U.S. Pat. No. 4,884,707 (CRISCI) in 1989; U.S. Pat. No. 4,645,088 (MENICHETTI) in 1987; and U.S. Pat. No. 4,905,852 (ZUMBUHL) in 1990.

These above-listed patents describe caps which do not need an additional seal in as much as they are provided with annular sealing lips and/or teeth (or ridges, protrusions) which are located under the closing disc, at the periphery of the cap or on its peripheral skirt, so as to find support on contact with the neck of the container and thereby provide the desired tightness. Such caps are designed for being directly connectable to recesses specifically provided for such purpose on the external surface of the container's neck.

If all the caps without additional seal known to the Applicant seem to work, it nevertheless remains that there exists a problem when the container to be closed is large, as it is the case for water containers of three, four or five gallons such as those used in upside down position in water distribution fountains. It is indeed difficult to obtain proper tightness with these kinds of containers, especially during their transportation. It is also difficult to obtain a good impermeability, tightness and hermetical effect required to insure that the purity of the container's content remains unaffected. Good impermeability is important to insure maintenance of purity. The use of caps made of one material, that is, without any seal, is also important in order to obtain this desired impermeability. One can understand here that the handling of the containers for storage and/or delivery purposes typically causes the liquid or water stored inside the container to move, which can create a strong surf or backwash effect. It also appears that the placement of the container in a reverse position, onto a distribution fountain for example, causes pressure to be exerted on the cap. This is because typical liquid flow out of the container gets replaced by air, the air having a pressure which accounts for the transfer by gravity. The atmosphere also exerts an external pressure which varies with environmental or metrological conditions such as temperature and pressure. It is the difficult equilibrium between internal and external container pressure that saves prior art caps from leaking; the balance must thus be well controlled.

In accordance with an object of the present invention, there is thus herein described a cap without additional seal which addresses the above-noted needs and prior art shortcomings, in terms of impermeability, tightness and hermetical effect.

SUMMARY

In accordance with an embodiment of the invention, the cap without additional seal for closing an opening at a container's neck comprises, as basic elements:

- a closing disc;
- a peripheral skirt sized to fit around the neck of the container, the peripheral skirt comprising an internal surface provided with engagement means for engaging with the neck of the container to thereby allow attachment of the cap to the neck;
- a first annular sealing lip projecting downwardly under the closing disc, near the opening of the neck, the first annular sealing lip being folded against the neck of the container, towards the opening thereof, when the cap is fixed in place, thus allowing neutralization of any surf effect when the container is moved; and
- a second annular sealing lip external to the first annular sealing lip, the second annular sealing lip being positioned to be folded against the neck of the container, in a direction opposite that of the first annular sealing lip when the cap is fixed in place.

The combination of the above-mentioned basic elements in a cap without additional seal is already known per se, as is confirmed in a non-limitative manner by the content of U.S. Pat. Nos. 4,416,383; 4,645,088 and 4,905,852 already mentioned hereinabove.

The cap according to the present invention differs from prior art caps in that at least the second annular lip also projects downwardly from under the closing disc, all around the first lip. The second lip is also provided with a number of protrusions (teeth or ridges) positioned to form a number of contact points with the neck of the container when the second lip is in the folded position and thus form a number of sealing barriers with a staircase effect. The protrusions, by matching the shape of the neck of the container, absorb surface defects and scratches caused by manufacturing imperfections or handling accidents.

It is worth mentioning that the use of little teeth or protuberances in a cap is already known per se, as is disclosed by way of non-limitative examples in U.S. Pat. Nos. 3,325,033; 4,106,653 and 4,884,707 already mentioned hereinabove. However, in these patents, the teeth or protrusions are not provided on a foldable lip, but rather directly on an internal surface of the cap., which does not at all result in the same final outcome. Such teeth or ridges essentially act as complementary sealing joints.

One will understand here that the fact of having teeth or protrusions on a lip permits, by way of a spring effect (or a flexibility effect) of the combination of lips and teeth and/or protrusions, to achieve a different kind of contact with the neck of bottles or containers.

According to a preferred embodiment of the invention, the first and second lips are connected so as to form a thicker joint region to reinforce their rigidity and effectively make the lips less flexible, thereby leading them to fold with greater pressure on the neck, ensuring a suction cup effect.

According to another a preferred embodiment of the invention, the closing disc has a lower surface provided with a circular recess forming a groove adjacent to the first lip. This groove also forms a folding space where the first lip may be folded, thereby providing better reflux in case of a backwash, and thus superior efficiency and sealing.

Still by preference, the peripheral skirt has an upper internal portion provided with a groove which forms, by its position, a third lip external to the first and second lips. This third lip creates a radial tension, applies a pressure onto the cap when this cap is attached to the neck and thus provides a superior tightening of the cap to an annular bead that is part of the neck, with maximal compression of the first and second lips in folded position, and the formation of an additional contact point with the neck.

As is of common practice, the peripheral skirt of the neck, according to an embodiment of the invention, is advantageously provided with a pulling tab associated with a score line in order to facilitate removal of the cap from the neck. The cap can also be made into one single piece of plastic material by injection moulding.

BRIEF DESCRIPTION OF THE DRAWINGS

The present invention and its advantages will be better understood upon reading the following non-restrictive description of preferred embodiments thereof, made with reference to the accompanying drawings wherein.

DETAILED DESCRIPTION

Figure 1:
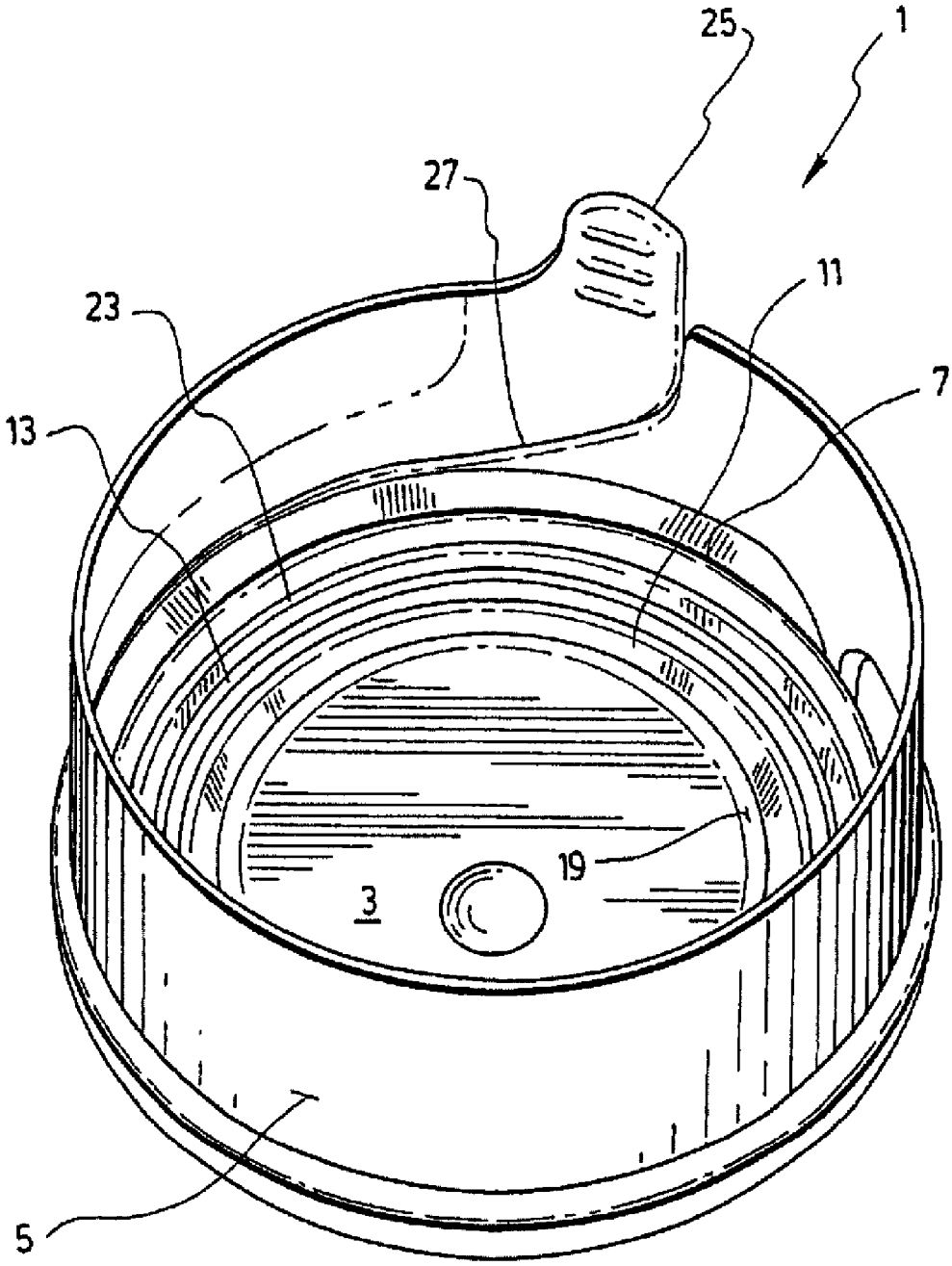
FIG. 1 is a bottom perspective view of a cap without additional seal in accordance with a preferred embodiment of the invention.
Figure 2:
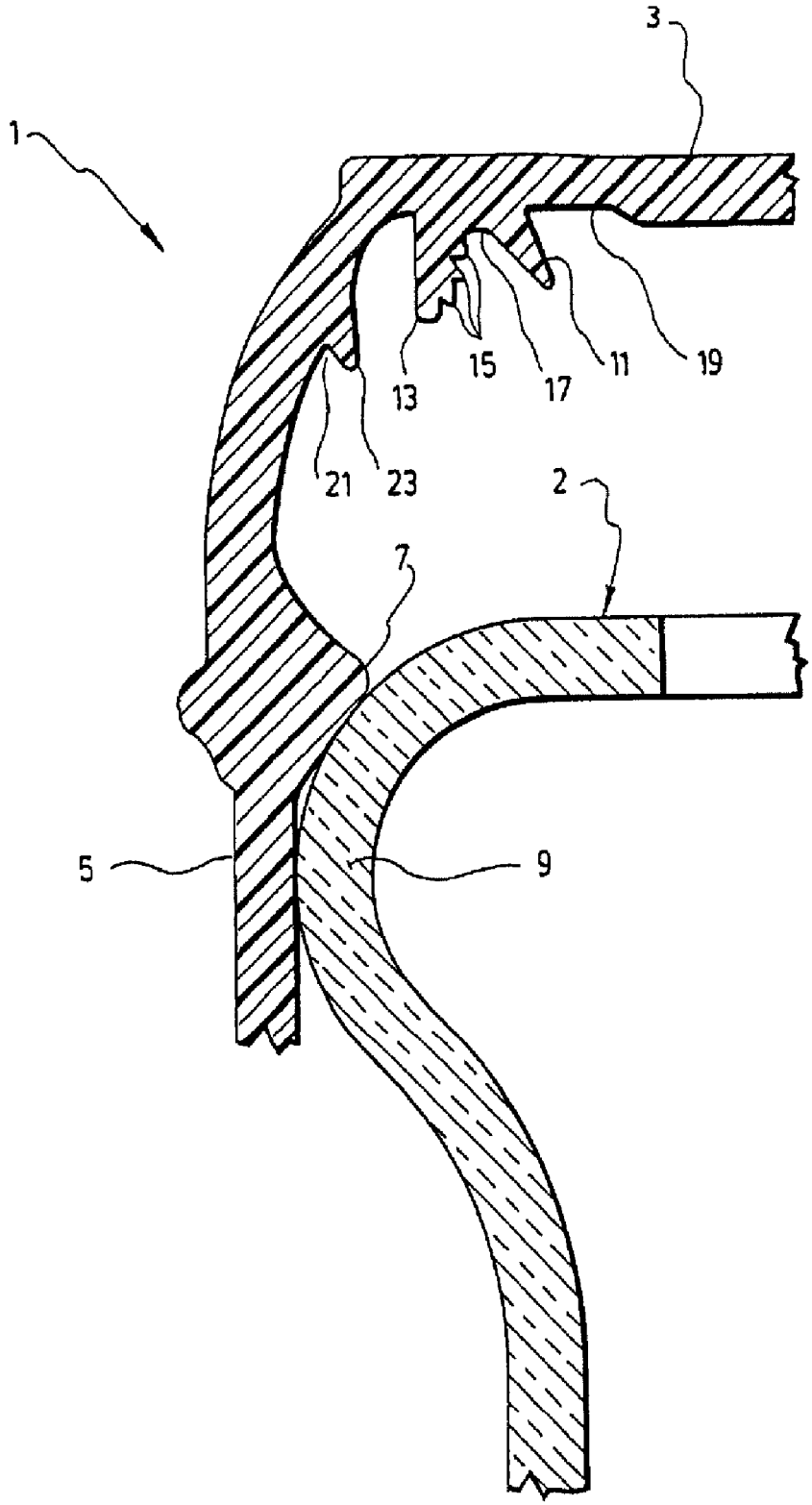
FIG. 2 is a partial cross-sectional view of the cap of FIG. 1 when positioned on disc of the neck of a container for installation purposes, in accordance with an embodiment.
Figure 3:
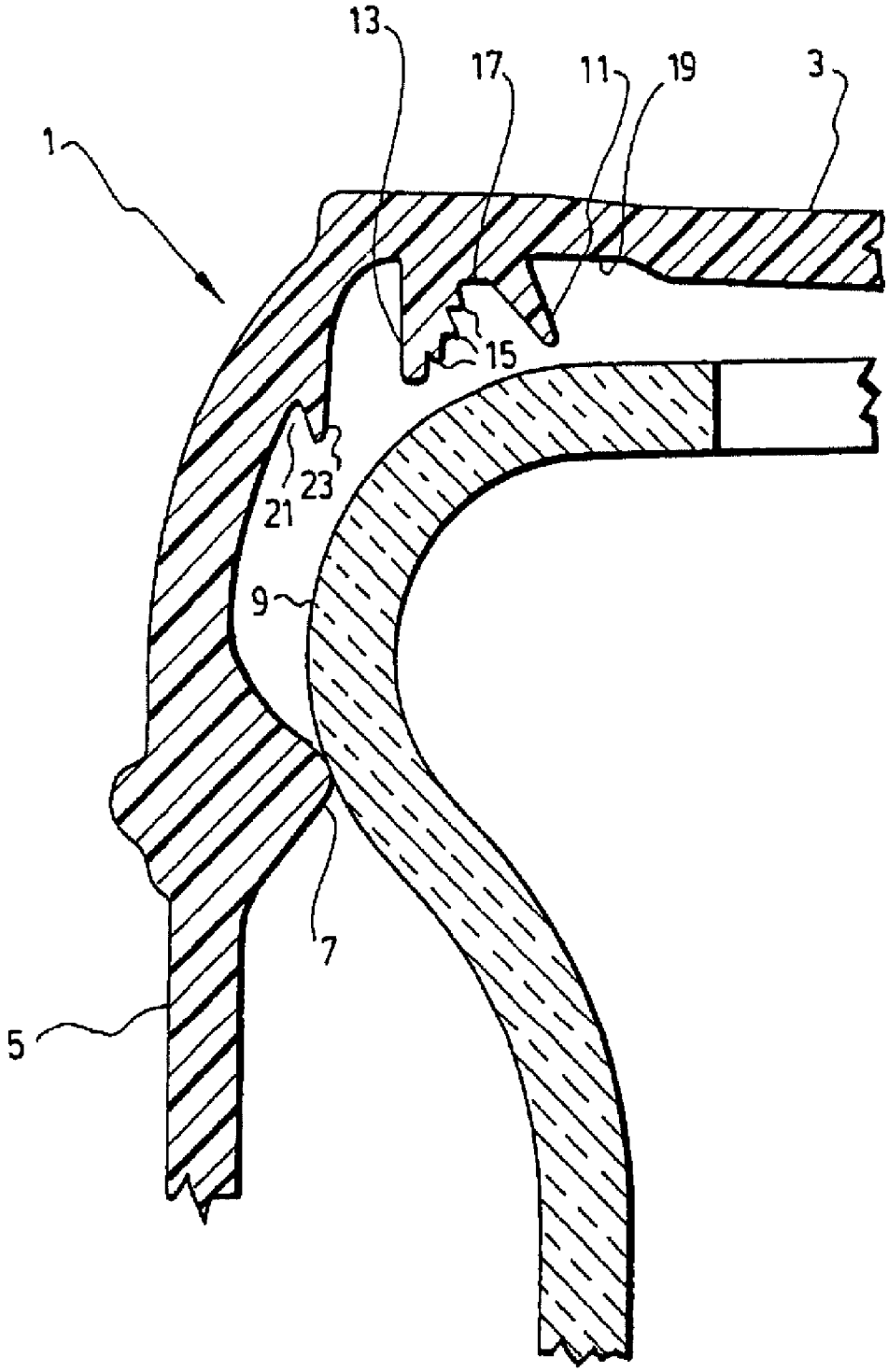
FIG. 3 is a view similar to FIG. 2, showing the cap when it is partially depressed.

The cap 1 without additional seal according to the preferred embodiment of the invention as shown in the accompanying drawings is intended to the be used for closing the opening of the neck 2 of a container such as, for example, a water container used in upside down position into a water dispenser. As is of common practice, the cap 1 comprises a closing disc 3 around which projects a peripheral skirt 5 sized to fit onto and around the neck 2. The skirt 5 has an internal surface provided with engaging means for engaging onto the neck of the container. In the illustrated embodiment, these engaging means consist of a tension ring 7 positioned so as to be able to be engaged to under an external bead 9 formed as part of the neck 2 in order to achieve proper attachment of the cap 1 onto the neck 2. The way the tension ring 7 gets positioned under the bead 9 of the neck 2 to keep it attached in closed position, is clearly illustrated in FIG. 4.

Of course, instead of using a tension ring 7, one could use any other engaging means, such as a screw system for example.

Figure 4:
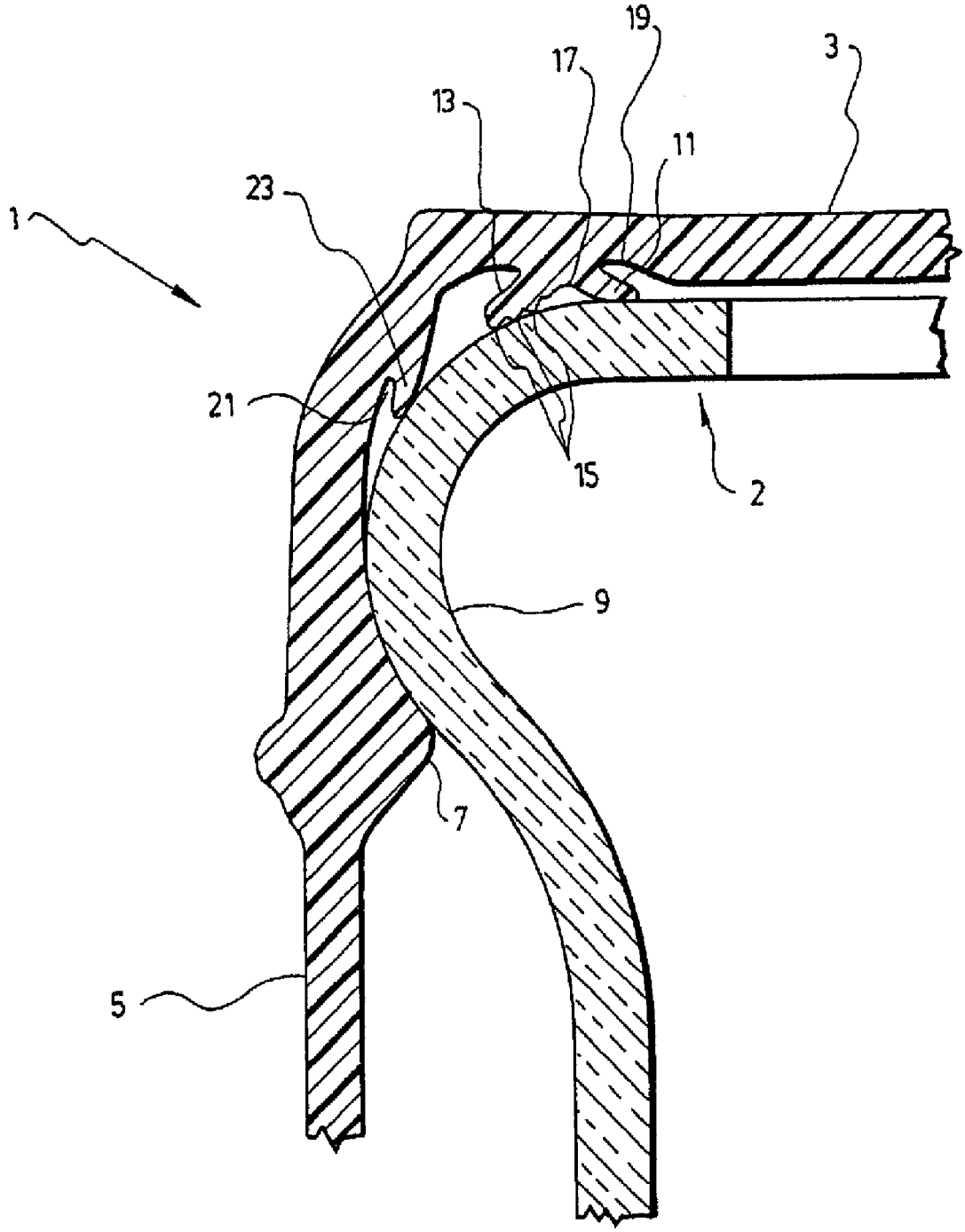
FIG. 4 is a view similar to FIGS. 2 and 3, showing the cap when it is completely installed onto the neck of the container.

The cap 1 also comprises a first annular sealing lip 11 which projects downwardly under the closing disc 3, close to the opening of the neck 2. In use, this first sealing lip is folded against the neck towards the opening of the same when the cap is attached to the neck, as is also shown in FIG. 4. In this folded position, the first lip 11 permits avoidance of any backwash effect when the container is moved.

The cap 1 also comprises a second sealing lip 13 which is external to the first lip and positioned so as to be also folded against the neck, in a direction opposite to a direction of the first lip when the cap is attached to the neck. The folded position of the second lip, once the cap is installed, is once again clearly illustrated in FIG. 4.

As aforesaid in the preamble of the present description, the above-mentioned basic structure of the cap 1 is already known per se.

In fact, the present invention actually lies in that the second lip 13 also projects downwardly from under the closing disc 3, all around the first lip 11, and is also provided with several protrusions such as teeth and/or ridges 15 positioned so as to form a plurality of contact points with the neck 2 when the second lip 13 is in a folded position. In this way, a plurality of sealing barriers is thus formed according to a staircase effect. Moreover, due to the fact that they match with the shape of the neck, the protrusions 15 absorb any surface defect or scratch due to manufacture imperfections or handling accidents.

Advantageously, the first and second lips 11 and 13 are connected so as to form a thicker joint which permits reinforcement of their rigidity and thus makes the lips less flexible. This brings the lips to fold with an increased folding pressure, preserves the action of a spring effect on the neck, and ensures the formation of a suction cup 17 effect.

As is shown in the drawings, the closing disc 3 can have a lower surface provided with a circular recess 19 which forms a groove adjacent to the first lip 11. In practice, this groove forms a space where the first lip 11 may be folded, and thus provides an easier reflux in case a backwash, and therefore offers a superior sealing. The particular positioning of the recess 19 and the advantages that it may have in use, are once again clearly illustrated in FIG. 4.

According to a particularly preferred embodiment of the invention, the peripheral skirt 5 has an internal upper part provided with a groove 21 which forms, thanks to its position for example, a third lip 23 external to the first and second lips. This third lip creates a radial tension and applies a pressure onto the cap when this cap is attached to the neck, providing a superior tightening of the tension ring 7 against the annular bead 9 of the neck, with a maximal compression of the first and second lips 11 and 13 in folded position. The third lip 23 also causes the formation of an additional contact point with the neck.

Of course, as is of common practice, the peripheral skirt can also be provided with a pulling tab 25 associated with a score line 27 to facilitate removal of the cap from the neck. The cap according to the invention is preferably made of one single piece of plastic material, by injection moulding.

Thanks to its structure, the cap according to the invention has several advantages. First of all, it gives a perfect impermeability of the neck. It also gives a good tightness while preventing any polluting agent to enter into the container. This is of course essential to prevent the liquid stored within the container from being inadvertently contaminated, especially when this liquid is intended for human consumption. Thus, the cap according to the invention has the advantage of being perfectly hermetic.

Thanks to the structure of the cap and the position of its lips, any undesired motion of water or any other liquid contained in the container after the same has been filled up, is prevented. During storage or delivery handling, risks of potential leaks are mitigated.

To this effect, it is worth noting again that the first lip 11 has the advantage of retaining any backwash caused by a motion of the liquid within the container. Thanks to the shape of the groove, it also permits the liquid to reflux. The third lip 23 also has the advantage of eventually correcting the difference relative to a given type of container to be closed, and thus ensures that appropriate pressure is applied on the tension ring 7. The position of the third lip 23 when the cap is installed causes more tension to be exerted onto the disc of the cap, and thus presses down the first and second lips 11 and 13 on disc of the neck with improved efficiency.

It follows that numerous modifications could be made to the embodiments that have been disclosed hereinabove without departing from the scope of the present invention as claimed hereinafter.

The invention claimed is:

1. A cap without additional seal for closing an opening at a neck of a container, the cap comprising:

a closing disc;

a peripheral skirt sized to fit around the neck, the peripheral skirt having an internal surface provided with engaging means for engaging the neck of the container to thereby allow attachment of the cap onto the neck;

a first annular sealing lip projecting downwardly from under the closing disc, near the opening at the neck, the first annular sealing lip being folded against the neck and toward the opening when the cap is attached, to thereby allow neutralization of any backwash effect when the container is moved; and a second annular sealing lip external to the first annular sealing lip and positioned so as to be also folded against the neck, in a direction opposite to that of the first annular sealing lip when the cap is attached onto the neck;

wherein the second annular sealing lip also projects downwardly from under the closing disc, around the first annular sealing lip, the second annular sealing lip being further provided with a plurality of teeth or protrusions positioned radially outwardly of the first sealing lip to interact with and form several contact points on a radially outwardly convex surface on the neck when the second lip is in a folded position, thus forming a plurality of sealing barriers with a staircase effect, the teeth or protrusions thereby matching a shape of the neck and absorbing surface defects, and wherein the peripheral skirt has an upper internal portion provided with a groove which forms, by its position, a third lip external to the first and second lips, wherein the third lip interacts with the radially outwardly convex surface of the neck, the third lip creating a radial tension, applying a pressure onto the cap when the cap is attached to the neck, and ensuring a tightening of a tension ring of the cap to an annular bead external to the neck, with a compression that occurs when the first and second lips are in a folded position, and with an additional contact point being formed with the neck.

2. The cap of claim 1, wherein the first and the second lips are connected so as to form a thicker joint section which reinforces a rigidity of the first and second lips and makes the first and second lips less flexible, to increase a pressure with which the first and second lips fold; to keep a spring effect on the neck; and to ensure a suction cup effect.

3. The cap of any one of claim 1 or 2, wherein the closing disc has a lower surface provided with a circular recess forming a groove adjacent to the first lip, the groove forming a space where the first lip may be folded, to thereby provide an easier reflux in case of a backwash, and thus offer a superior efficiency and sealing.

4. The cap of claim 1, wherein the peripheral skirt is provided with a pulling tab associated with a score line in order to facilitate removal of the cap from the neck.

5. The cap of claim 1, wherein the cap is made by injection moulding into one single piece of plastic material.

6. The cap of claim 1, wherein the container is a liquid container.

7. The cap of claim 1, wherein the plurality of teeth or protrusions are provided linearly on one side of the second sealing lip facing the first sealing lip.

8. A cap without additional seal for closing an opening at a neck of a container, the cap comprising:

a closing disc;

a peripheral skirt sized to fit around the neck, the peripheral skirt having an internal surface with an engaging device configured to engage the neck of the container to allow attachment of the cap onto the neck;

a first annular sealing lip projecting downwardly from under the closing disc, near the opening at the neck, the first annular sealing lip being folded against the neck and toward the opening when the cap is attached to the neck; and a second annular sealing lip external to the first annular sealing lip and positioned so as to be folded against the neck in a direction opposite to that of the first annular sealing lip when the cap is attached to the neck;

wherein the second annular sealing lip projects downwardly from under the closing disc, completely around the first annular sealing lip, the second annular sealing lip including a plurality of protrusions positioned radially outwardly of the first sealing lip to interact with and form several contact points on a radially outwardly convex surface on the neck when the second lip is in a folded position, thus forming a plurality of sealing barriers, wherein the protrusions substantially match a shape of the neck, and wherein the peripheral skirt has an upper internal portion provided with a groove which forms, by its position, a third lip external to the first and second lips, wherein the third lip interacts with the radially outwardly convex surface of the neck, the third lip creating a radial tension, applying a pressure onto the cap when the cap is attached to the neck, and ensuring tightening of a tension ring of the cap to an annular bead external to the neck, with a compression that occurs when the first and second lips are in a folded position, and with an additional contact point being formed with the neck.

9. The cap of claim 8, wherein the first and the second lips are connected so as to increase a thickness of a joint section to reinforce rigidity and reduce flexibility of the first and second lips, and to increase a pressure with which the first and second lips fold.

10. The cap of claim 8, wherein the closing disc has a lower surface provided with a circular recess forming a groove adjacent to the first lip, the groove forming a space into which the first lip may be folded.

11. The cap of claim 8, wherein the peripheral skirt includes a pulling tab and a score line configured to facilitate removal of the cap from the neck.

12. The cap of claim 8, wherein the cap is made by injection moulding into one single piece of plastic material.

13. The cap of claim 8, wherein the container is a liquid container.

14. The cap of claim 8, wherein the plurality of protrusions are provided linearly on one side of the second sealing lip facing the first sealing lip.

15. A cap for closing an opening at a neck of a container, the cap comprising:

a closing disc;

a peripheral skirt configured to fit around the neck and including a tension ring for engaging with the neck of the container;

a first annular sealing lip projecting downwardly from the closing disc and configured to be folded against the neck and toward the opening when the cap is attached to the neck; and a second annular sealing lip external to the first annular sealing lip and configured to be folded against the neck in a direction opposite to that of the first annular sealing lip when the cap is attached to the neck;

wherein the second annular sealing lip projects downwardly from the closing disc, around the first annular sealing lip, and wherein the second annular sealing lip includes a plurality of protrusions located radially outwardly of the first sealing lip and configured to interact with and form a plurality of contact points on a radially outwardly convex surface on the neck when the second lip is in a folded position, wherein the protrusions are substantially complimentary to a shape of the neck, and wherein the peripheral skirt includes an upper internal portion having a groove which forms a third lip external to the first and second lips, wherein the third lip is configured to interact with the radially outwardly convex surface of the neck, create a radial tension, apply a pressure onto the cap when the cap is attached to the neck, and allow for tightening of a tension ring of the cap to an annular bead external to the neck, wherein a compression occurs when the first and second lips are in a folded position, and wherein an additional contact point for the third lip is formed on the neck such that the third lip is configured to contact the neck when the cap is attached to the neck.

16. The cap of claim 15, wherein the first annular sealing lip is connected to and adjacent the second annular sealing lip.

* * * * *